US010147526B2

(12) United States Patent
Chung et al.

(10) Patent No.: US 10,147,526 B2
(45) Date of Patent: Dec. 4, 2018

(54) SLIDING VARIABLE RESISTOR

(71) Applicant: FORWARD ELECTRONICS CO., LTD., Taipei (TW)

(72) Inventors: Ching-Hao Chung, Kaohsiung (TW); Chun-Lin Huang, Kaohsiung (TW); Hsiu-Chen Li, Pingtung County (TW)

(73) Assignee: FORWARD ELECTRONICS CO., LTD., Taipei (TW)

( * ) Notice: Subject to any disclaimer, the term of this patent is extended or adjusted under 35 U.S.C. 154(b) by 208 days.

(21) Appl. No.: 15/412,103

(22) Filed: Jan. 23, 2017

(65) Prior Publication Data

US 2017/0316854 A1 Nov. 2, 2017

(30) Foreign Application Priority Data

Apr. 28, 2016 (TW) ..... 105113236 A

(51) Int. Cl.
*H01C 10/38* (2006.01)
*H01C 1/02* (2006.01)
*H01C 10/44* (2006.01)

(52) U.S. Cl.
CPC ..... *H01C 10/38* (2013.01); *H01C 1/02* (2013.01); *H01C 10/44* (2013.01)

(58) Field of Classification Search
CPC ..... H01C 10/38; H01C 1/02; H01C 10/30
USPC ..... 338/176, 118
See application file for complete search history.

(56) References Cited

U.S. PATENT DOCUMENTS 6,617,958 B1 * 9/2003 Hwan ..... G01D 5/30 250/214 PR
2003/0117256 A1 * 6/2003 Miura ..... H01C 10/38 338/176

* cited by examiner

*Primary Examiner* — Kyung Lee
*Assistant Examiner* — Iman Malakooti
(74) *Attorney, Agent, or Firm* — Bacon & Thomas, PLLC

(57) ABSTRACT

A sliding variable resistor includes a sliding base, a first supporting pole, two buffering members, a substrate, a casing assembly, an anchoring plate, a driving member, a driven member, a belt, and a belt guard. The sliding base includes two first through hole and at least one variable resistor sheet. The first supporting pole is inserted into the two first through hole. The first supporting pole has its two ends abut against the first buffering seats, respectively. The substrate is engaged with the two buffering members. The two buffering members are arranged in the casing assembly. The anchoring plate is fixedly arranged on the casing assembly. The belt is engaged with the driving member and the driven member, respectively. The belt guard is fastened to the sliding base, and is engaged with the belt. As such, the sliding base, while sliding, can have an improved smoothness.

10 Claims, 5 Drawing Sheets

SLIDING VARIABLE RESISTOR

CROSS REFERRENCE TO RELATED APPLICATION

This application claims the benefits of the Taiwan Patent Application Serial Number 105113236, filed on Apr. 28, 2016, the subject matter of which is incorporated herein by reference.

BACKGROUND OF THE INVENTION

1. Field of the Invention

The present invention relates to a sliding variable resistor, and more particularly, to a sliding variable resistor using supporting poles to improve sliding smoothness and accuracy of position adjustment for a sliding base.

2. Description of Related Art

Variable resistors relate to common electronic facilities, provided for occasions requiring voltage regulation or resistance variation of circuits, so as to tune the volume of players and to adjust the brightness of light. As such, the demand of facility users can be satisfied.

There are several models for variable resistors to vary resistance, including those of frequently seen such as sliding type and rotary type. A sliding variable resistor, through the structural design of a sliding base and a substrate, the sliding base can be moved so as to vary positions relative to the sliding base and the substrate. Further, through varying a contact point between a resistor sheet of the sliding base and a resistor carbon film of the substrate, resistance can be varied continuously and adjusted to a value of resistance as required.

Generally speaking, in the sliding variable resistor, a sliding structure, consisting of the sliding base and the substrate, is mostly made of plastic material. Plastic material is sensitive to variation of temperature, and thus a phenomenon of hot-expansion and cold-contraction to the sliding structure is quite apparent. This will make the sliding base unable to slide smoothly due to a deformation of the sliding structure, causing a feeling of undesirable quality when manually moving the sliding structure by hand. Besides, the phenomenon of hot-expansion and cold-contraction results in a non-uniform contact pressure on the resistor sheet of the sliding base and the resistor carbon film of the substrate, adversely affecting the life of use for the products.

Given the above, through a spirit of aggressive innovation, a "Sliding Variable Resistor" has been conceived, such that by utilizing a sliding base, supporting poles, and sleeve rings, a feeling of smoothness in manually moving the sliding base can be enhanced. As such, a resistor sheet of the sliding base can contact with, and slide over, a substrate at a stable contact pressure, so as to achieve the purposes of accurately controlling resistance and increasing life of use for the products. To solve the above-mentioned problem, persistent research and experiments for the "Sliding Variable Resistor" are undertaken, eventually resulting in accomplishment of the present invention.

SUMMARY OF THE INVENTION

An object of the present invention is to provide a sliding variable resistor, by using supporting poles to improve sliding smoothness and accuracy of position adjustment for a sliding base so as to achieve the purpose of smooth sliding.

To achieve the above object, the sliding variable resistor, according to the present invention, comprises a sliding base, a first supporting pole, two buffering members, a substrate, a casing assembly, an anchoring plate, a driving member, a driven member, a belt, and a belt guard.

According to the present invention, the sliding base includes a manipulating handle, at least one first through hole, and at least one variable resistor sheet. The manipulating handle is provided with a fastening hole. The first supporting pole is inserted into the at least one first through hole. The buffering members each include a first buffering seat and at least one first protrusion. The first supporting pole has its two ends abut against the first buffering seats, respectively. The substrate includes at least two holes, and that the at least one first protrusion is engaged with the at least two holes, respectively. The two buffering members are arranged in the casing assembly. The anchoring plate is fixedly arranged on the casing assembly, and includes a long window and an axle hole. The driving member is fixedly arranged at an end of the anchoring plate, and includes a motor and a driving wheel. The motor includes a rotating shaft passing through the axle hole. The driving wheel is fixed to the rotating shaft and rotates together therewith. The driven member is fixedly arranged at another other end of the anchoring plate, and includes a threaded pillar and a driven wheel. The driven wheel is pivotally arranged on the threaded pillar, and that the belt is engaged with the driving wheel and the driven wheel, respectively. The belt guard includes at least one fastening portion and an engaging portion such that the at least one fastening portion is fastened to the fastening hole, and that the engaging portion is engaged with the belt.

The sliding variable resistor, according to the present invention, may further comprise a second supporting pole, and that the sliding base further includes a sidewall portion having a second through hole, and that the buffering members each further include a second buffering seat. The second supporting pole passes through the second through hole, and that the second supporting pole has its two ends abut against the second buffering seats, respectively.

The sliding variable resistor, according to the present invention, may further comprise a plurality of sleeve rings inserted into the at least one first through hole and the second through hole.

The sliding variable resistor, according to the present invention, may further comprise two buffering rings each embedded into each of the two first buffering seats.

The sliding variable resistor, according to the present invention, may further comprise a guarding pad interposed between the motor and the driving wheel, where the guarding pad is provided with a through hole through which the rotating shaft passes.

According to the present invention, the casing assembly may further include a lower casing and an upper casing, wherein the lower casing is provided with two engaging holes, and the upper casing includes two engaging portions each engaged with each of the engaging holes.

Further, according to the present invention, the lower casing may further include two first hinging portions, and that the upper casing may further include two second hinging portions. The anchoring plate may further include four hinging boards engaged correspondingly with the two first hinging portions and the two second hinging portions, respectively.

Still further, the belt guard may further include a first stop portion and two second stop portions, wherein the first stop portion and the two second stop portions are employed to enclose the belt.

According to the present invention, the lower casing may further include a first dust-preventing portion, and that the upper casing may further include a second dust-preventing portion. The manipulating handle may further include a turning portion, such that a space for receiving the first dust-preventing portion is formed at the turning portion, where the turning portion is located beneath the second dust-preventing portion.

Further, according to the present invention, the substrate may further include a connector, and that the upper casing may further include an opening portion corresponding to the connector.

Still further, according to the present invention, the buffering members may each further include a second protrusion, and that the lower casing is provided, at two sides and in a longitudinal direction, with a slot, respectively, such that the second protrusion corresponds to the slot.

According to the present invention, the lower casing may further include two positioning portions, and that the upper casing may further include two positioning holes corresponding to the two positioning portions.

Further, according to the present invention, the lower casing may further include two position-limiting portions, and that the anchoring plate may further include two position-limiting holes corresponding to the position-limiting portions.

Still further, according to the present invention, the lower casing may further include two circular holes, and that the upper casing further include two protrusions corresponding to the two circular holes.

According to the present invention, both the first supporting pole and the second supporting pole have an outer diameter equal to or smaller than an inner diameter of the sleeve rings.

Further, according to the present invention, the anchoring plate may further include a first through hole for fixedly arranging the driven member, where the first through hole appears as a longitudinal hole along a longitudinal direction of the anchoring plate.

Still further, according to the present invention, the anchoring plate may further include two mounting portions each provided with a mounting hole through which the sliding variable resistor can be attached.

According to the present invention, the sleeve rings are made of metallic material and are coated, on their surfaces, with Polyterafluorethene (PTFE).

Further, according to the present invention, the sliding base may further include a contact sheet, which is in contact with the substrate, such that during an automatic sliding of the sliding base effected by the motor to drive the belt in adjusting the value of resistance while a user instead attempts to manually adjust the value of resistance, the contact sheet can be relied on to detect variation of capacitance, so that the user, with a sensing device incorporated, can stop immediately running of the motor at the moment the user touches the sliding base. This will facilitate the user manually sliding the sliding base for adjusting the value of resistance.

Other objects, advantages, and novel features of the present invention will become more apparent from the following detailed descriptions when taken in conjunction with the accompanying drawings.

DETAILED DESCRIPTION OF THE PREFERRED EMBODIMENTS

Figure 1:
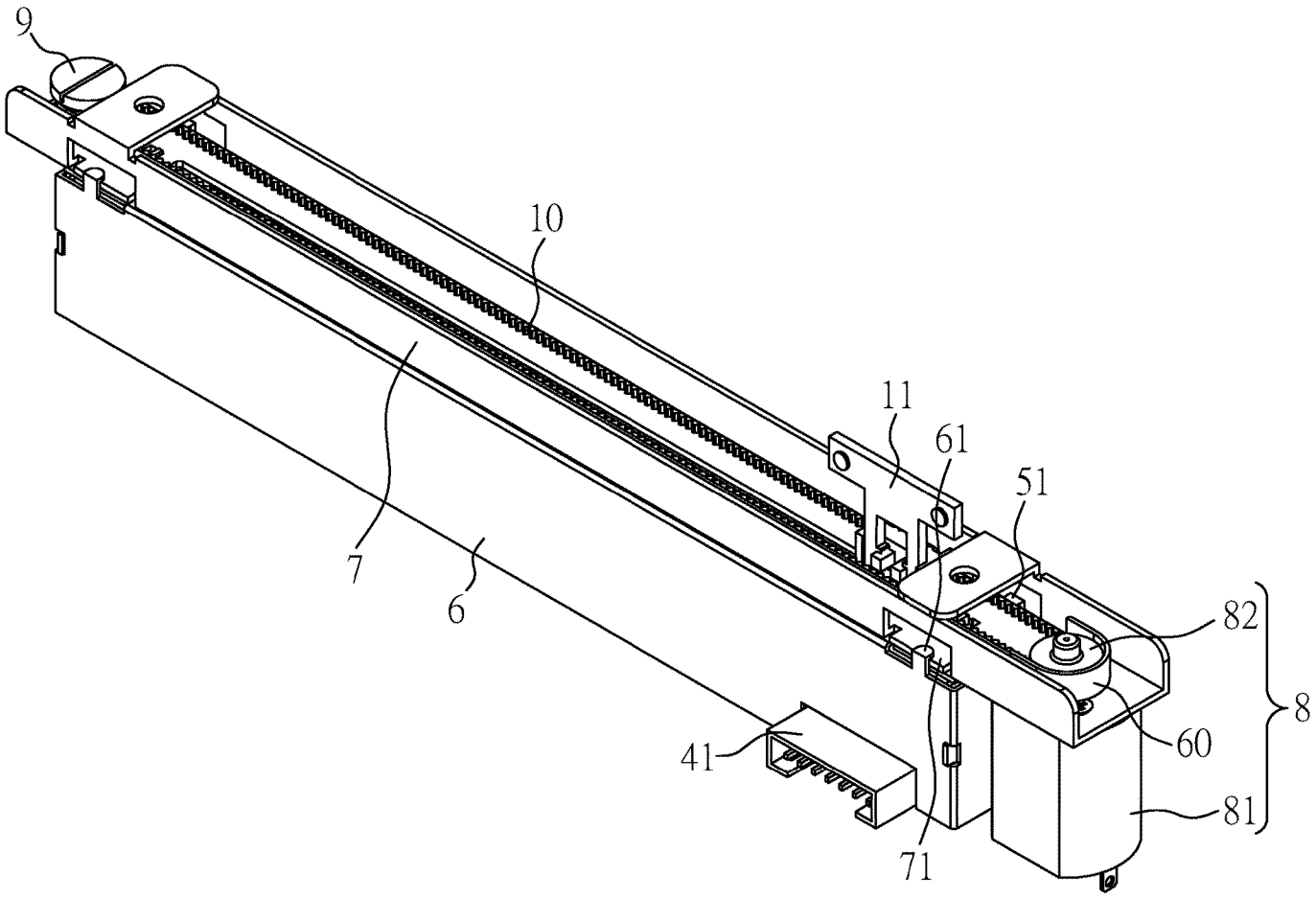
FIG. 1 is a perspective view illustrating a sliding variable resistor according to the present invention.
Figure 2:
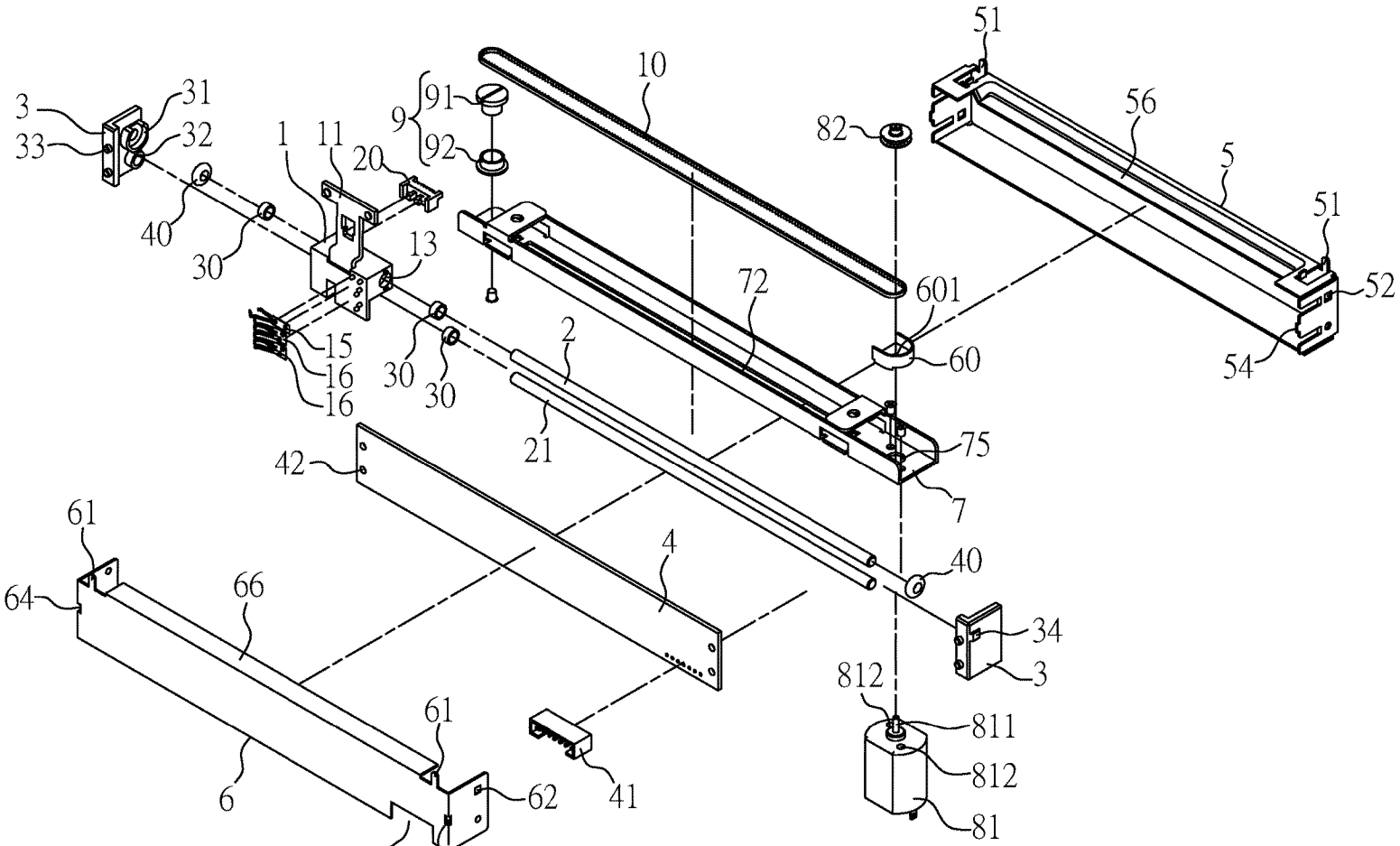
FIG. 2 is an exploded view illustrating the sliding variable resistor according to the present invention.

References are made to FIG. 1, a perspective view illustrating a sliding variable resistor according to the present invention; FIG. 2, an exploded view illustrating the sliding variable resistor; and FIGS. 3, 4, and 5, exploded views illustrating parts of the sliding variable resistor.

According to the present invention, the sliding variable resistor comprises a sliding base 1, a first supporting pole 2, a second supporting pole 21, two buffering members 3, a substrate 4, a casing assembly 50, an anchoring plate 7, a driving member 8, a driven member 9, a belt 10, a belt guard 20, three sleeve rings 30, two buffering rings 40, and a guarding pad 60.

Figure 3:
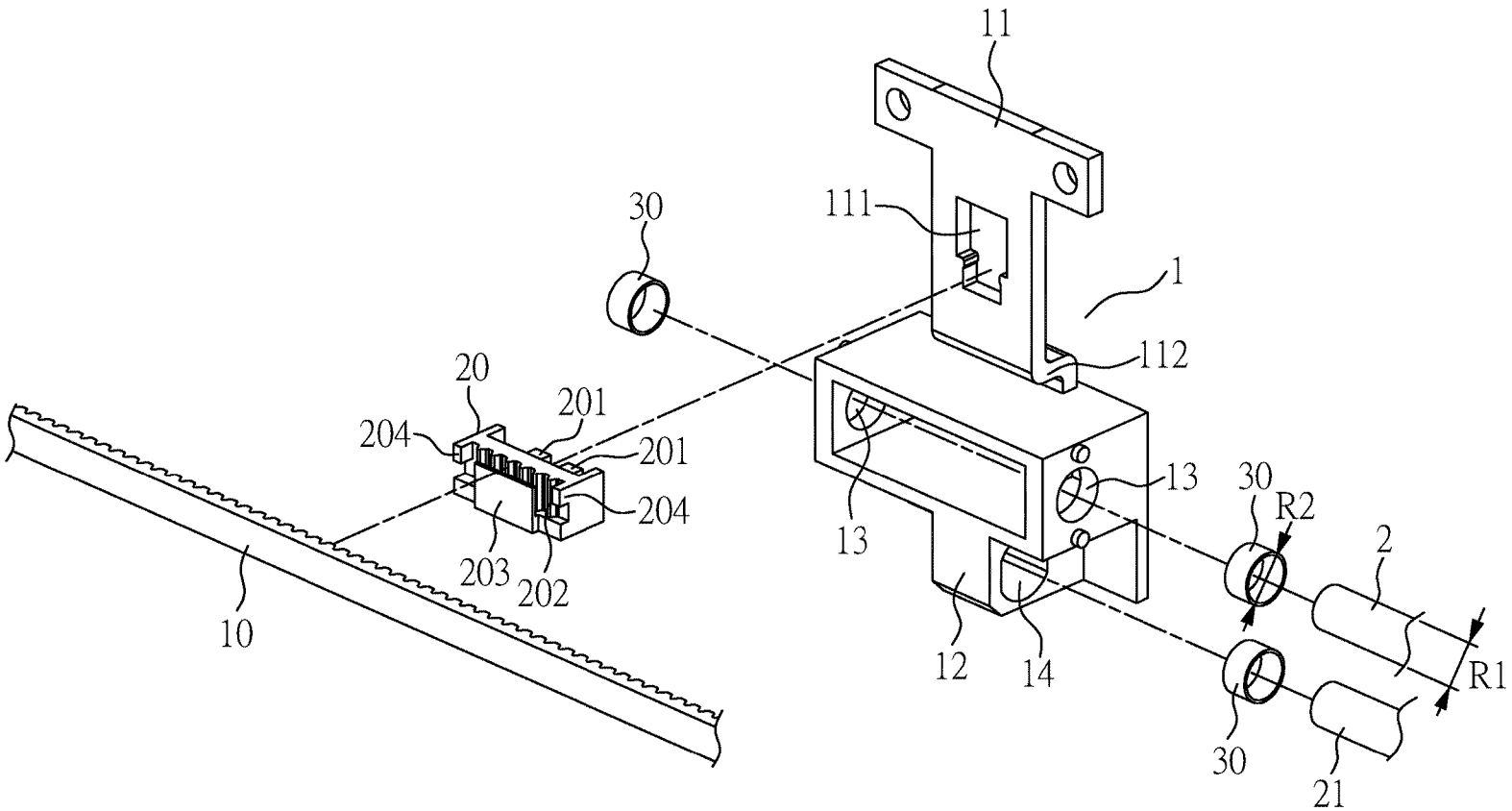
FIG. 3 is an exploded view illustrating part of the sliding variable resistor according to the present invention.

Further, as shown in FIG. 2 and FIG. 3, the sliding base 1 includes a manipulating handle 11, a sidewall portion 12, two first through holes 13, a second through hole 14, a contact sheet 15, and two variable resistor sheets 16. The manipulating handle 11 is provided with a fastening hole 111. and a turning portion 112. The second through hole 14 is located at the sidewall portion 12. The three sleeve rings 30 are inserted into the two first through holes 13 and into the second through hole 14. The first supporting pole 2 and the second supporting pole 21 are inserted into the sleeve rings 30 inside the first through holes 13, and into the sleeve ring 30 inside the second through hole 14. Both the first supporting pole 2 and the second supporting pole 21 have an outer diameter R1 equal to or smaller than an inner diameter R2 of the sleeve rings 30. The sleeve rings 30 are made of metallic material and are coated, on their surfaces, with Polyterafluorethene (Teflon™). Polyterafluorethene has a heat-resistant characteristic, and has an extremely low friction coefficient, and thus has a function of lubrication. Therefore, the sliding base 1 can slide smoothly on the first supporting pole 2 and the second supporting pole 21 so as to enhance a feeling of manually moving the sliding base 1.

The buffering members 3 each include a first buffering seat 31, a second buffering seat 32, two first protrusions 33, and a second protrusion 34. The first supporting pole 2 and the second supporting pole 21 both have their two ends abut against the first buffering seat 31 and the second buffering seat 32, respectively. The two buffering rings 40 are each embedded into each of the first buffering seats 31, respectively, so that the contact sheet 15 and the two variable resistor sheets 16 of the sliding base 1 will have a more stable contact pressure with the substrate 4. This will avoid an uneven contact pressure during a sliding motion which will cause an abnormal life of use for the sliding variable resistor.

Figure 4:
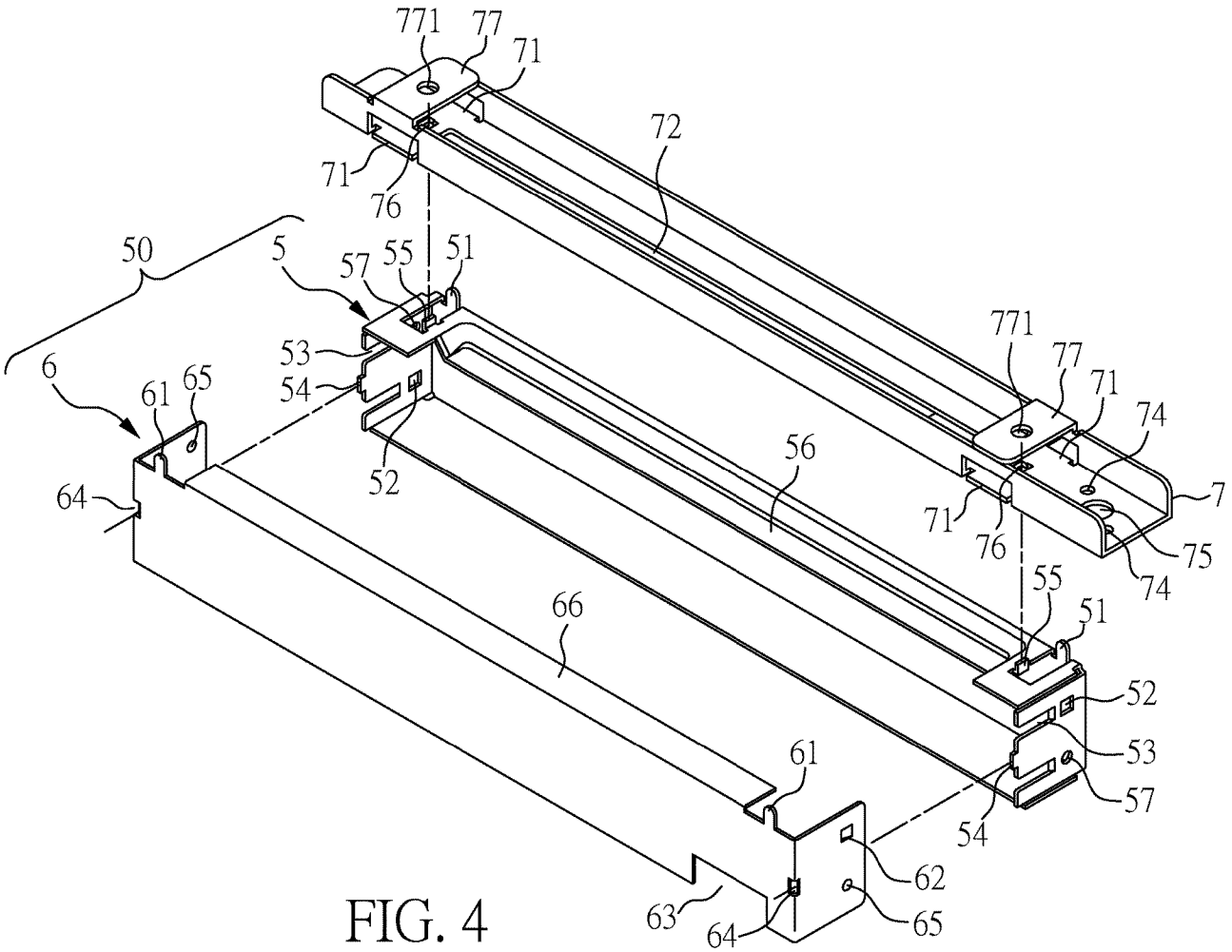
FIG. 4 is an exploded view illustrating another part of the sliding variable resistor according to the present invention.
Figure 5:
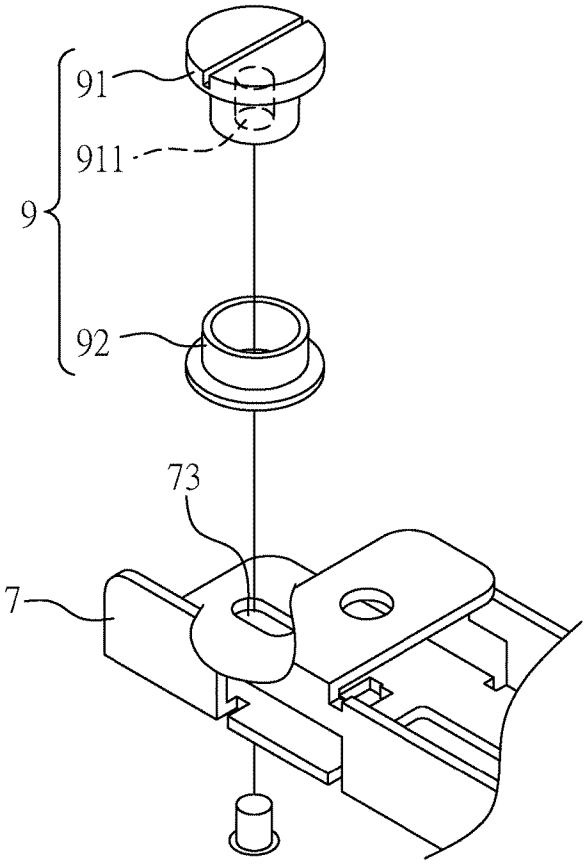
FIG. 5 is an exploded view illustrating still another part of the sliding variable resistor according to the present invention.

According to the present invention, the substrate 4 includes a connector 41 and is provided with four holes 42. The first protrusions 33 are each engaged with each of the holes 42. As shown in FIG. 4, the casing assembly 50 includes a lower casing 5 and an upper casing 6, wherein the two buffering members 3 are arranged in the casing assembly 50. The lower casing 5 includes two first hinging portions 51, two engaging holes 52, two slots 53, two positioning portions 54, two position-limiting portions 55, a first dust-preventing portion 56, and two circular holes 57. The two buffering members 3 are arranged, respectively, at two sides of the lower casing 5, in a longitudinal direction, and inside thereof, such that the second protrusions 34 of the buffering members 3 are engaged with the slots 53. As such, the buffering members 3 can be positioned in the casing assembly 50 more precisely.

The upper casing 6 is engaged with the lower casing 5, and includes two second hinging portions 61, two engaging portions 62, one opening portion 63, two positioning holes 64, two protrusions 65, and a second dust-preventing portion 66. The engaging portions 62 are each engaged with each of the engaging holes 52. As the engaging portions 62 are engaged with the engaging holes 52, the protrusions 65 are each inserted into each of the circular holes 57, such that the engaging holes 52 and the engaging portions 62 play a securing function, while the circular holes 57 and the protrusions 65 play a positioning function. This will prevent the lower casing 5 and the upper casing 6 from rocking after the same are engaged with each other. The two positioning portions 54 are inserted into two positioning holes 64 such that the lower casing 5 and the upper casing 6 can be engaged securely with each other so as to form the casing assembly 50. The connector 41, corresponding to the opening portion 63, emerges from the casing assembly 50 so as to output signals of resistance variation from the substrate 4.

The anchoring plate 7 includes four hinging boards 71, a long window 72, a first through hole 73, two second through holes 74, an axle hole 75, two position-limiting holes 76, and two mounting portions 77. As shown in FIG. 4, all the first hinging portions 51 and the second hinging portions 61 extend upward as pillar-like structures such that, after engaging the lower casing 5 with the upper casing 6 and forming the casing assembly 50, the anchoring plate 7 is disposed on the casing assembly 50 and then a hinging work is undertaken. The first hinging portions 51 and the second hinging portions 61 are all bent, at their upper ends, toward the long window 72 such that the four hinging boards 71 are engaged correspondingly with the first hinging portions 51 and the second hinging portions 61, respectively (see FIG. 1). Thereafter, the two position-limiting portions 55 are inserted correspondingly into the two position-limiting holes 76, respectively, such that the anchoring plate 7 can be secured on the casing assembly 50. The mounting portions 77 are each provided with a mounting hole 771 through which a user can attach the sliding variable resistor to a required position.

According to the present invention, the user can use the manipulating handle 11 of the sliding base 1 to be arranged in the long window 72, and then operate manually the manipulate handle 11 to move the sliding base 1 along the first supporting pole 2 and the second supporting pole 21, and inside the long window 72, so as to adjust the value of resistance. Besides, in order to prevent dust and foreign materials, coming from surroundings, from falling into inside of the casing assembly 50 through the long window 72, according to the present invention, a structural design utilizes the turning portion 112 of the sliding base 1 (see FIG. 3). Namely, a structural design incorporates the first dust-preventing portion 56 and the second dust-preventing portion 66, such that a space for receiving the first dust-preventing portion 56 is formed at the turning portion 112, where the first dust-preventing portion 56 is located beneath the turning portion 112, and the second dust-preventing portion 66 above the turning portion 112. As such, the first dust-preventing portion 56 and the second dust-preventing portion 66 will serve to prevent dust and foreign materials, coming from surroundings, from falling into inside of the casing assembly 50 through the long window 72.

Further, according to the present invention, the driving member 8 includes a motor 81 and a driving wheel 82. The motor 81 includes a rotating shaft 811 and two fastening holes 812, where the two fastening holes 812 correspond to the two second through holes 74, through which the motor 81 can be fastened and secured to the anchoring plate 7. The rotating shaft 811 passes, in sequence, through the axle hole 75 and a through hole 601 of the guarding pad 60. The guarding pad 60 is interposed between the motor 81 and the driving wheel 82. The driving wheel 82 is fixed to the rotating shaft 811 and rotates together therewith.

According to the present invention, the driven member 9 includes a threaded pillar 91 and a driven wheel 92. The threaded pillar 91 is provided with a threaded hole 911 corresponding to the first through hole 73, through which the driven member 9 can be fastened and secured to the anchoring plate 7. The driven wheel 92 is pivotally arranged on the threaded pillar 91, and that the belt 10 is engaged with the driving wheel 82 and the driven wheel 92, respectively. The first through hole 73 appears as a longitudinal hole along a longitudinal direction of the anchoring plate 7 (see FIG. 5). Thereby, the user, upon mounting the belt 10 around the driving wheel 82 and the driven wheel 92, can adjust tension of the belt 10 by altering the fastening position of the threaded pillar 91 onto the first through hole 73. The guarding pad 60 relates to a structure formed around the driving wheel 82 for preventing the belt 10, which is engaged with the driving wheel 82, from escaping from the driving wheel 82 during operation.

Further, according to the present invention, the belt guard 20 includes two fastening portions 201, an engaging portion 202, a first stop portion 203, and two second stop portions 204. The two fastening portions 201 are fastened to the fastening hole 111 of the sliding base 1. The engaging portion 202 is engaged with the belt 10 such that the first stop portion 203 and the two second stop portions 204 are employed to enclose the belt 10 (see FIG. 3). Thereby, no matter whether the user manually slides the sliding base 1; or under an automatic operation that the motor 81 rotates the driving wheel 82 to drive the belt 10 so as to slide the sliding base 1, the belt 10, upon interacting with the belt guard 20, will not escape from the belt guard 20.

Given the above, it is understood that the sliding variable resistor, according to the present invention, utilizes the sliding base 1, having the first through holes 13 and the second through hole 14, to incorporate the first supporting pole 2, the second supporting pole 21, the buffering members 3, and the sleeve rings 30, so as to slide the sliding base 1 stably and smoothly within the casing assembly 50. As such, the contact pressure between the contact sheet 15 and the two variable resistor sheets 16 of the sliding base 1 and the substrate 4 can be effectively controlled so as to achieve the purposes of accurately controlling resistance and increasing life of use for the products.

Although the present invention has been explained in relation to its preferred embodiments, it is to be understood that many other possible modifications and variations can be made without departing from the scope of the invention as hereinafter claimed.

What is claimed is:

1. A sliding variable resistor, comprising:

a sliding base, including a manipulating handle, at least one first through hole, and at least one variable resistor sheet, wherein the manipulating handle is provided with a fastening hole;

a first supporting pole, inserted into the at least one first through hole;

two buffering members, each including a first buffering seat and at least one first protrusion, wherein the first supporting pole has its two ends abut against the first buffering seats, respectively;

a substrate, including at least two holes, wherein the at least one first protrusion is engaged with the at least two holes, respectively;

a casing assembly, wherein the two buffering members are arranged in the casing assembly;

an anchoring plate, fixedly arranged on the casing assembly, and including a long window and an axle hole;

a driving member, fixedly arranged at an end of the anchoring plate, and including a motor and a driving wheel, wherein the motor includes a rotating shaft passing through the axle hole, and the driving wheel is fixed to the rotating shaft and rotates together therewith;

a driven member, fixedly arranged at another other end of the anchoring plate, and including a threaded pillar and a driven wheel, wherein the driven wheel is pivotally arranged on the threaded pillar;

a belt, engaged with the driving wheel and the driven wheel, respectively; and a belt guard, including at least one fastening portion and an engaging portion such that the at least one fastening portion is fastened to the fastening hole, wherein the engaging portion is engaged with the belt.

2. The sliding variable resistor as claimed in claim 1, further comprising a second supporting pole, wherein the sliding base further includes a sidewall portion having a second through hole, and the buffering members each further include a second buffering seat; and wherein the second supporting pole passes through the second through hole, and the second supporting pole has its two ends abut against the second buffering seats, respectively.

3. The sliding variable resistor as claimed in claim 2, further comprising a plurality of sleeve rings inserted into the at least one first through hole and the second through hole.

4. The sliding variable resistor as claimed in claim 1, wherein the casing assembly further includes a lower casing and an upper casing, wherein the lower casing is provided with two engaging holes, and the upper casing includes two engaging portions each engaged with each of the engaging holes.

5. The sliding variable resistor as claimed in claim 4, wherein the lower casing further includes two first hinging portions, and the upper casing further includes two second hinging portions; and wherein the anchoring plate further includes four hinging boards engaged correspondingly with the two first hinging portions and the two second hinging portions, respectively.

6. The sliding variable resistor as claimed in claim 1, further comprising two buffering rings each embedded into each of the two first buffering seats.

7. The sliding variable resistor as claimed in claim 1, wherein the belt guard further includes a first stop portion and two second stop portions, Wherein the first stop portion and the two second stop portions are employed to enclose the belt.

8. The sliding variable resistor as claimed in claim 1, wherein the anchoring plate further includes a first through hole for fixedly arranging the driven member, and the first through hole appears as a longitudinal hole along a longitudinal direction of the anchoring plate.

9. The sliding variable resistor as claimed in claim 4, wherein the lower casing further includes a first dust-preventing portion, and the upper casing further includes a second dust-preventing portion, and the manipulating handle further includes a turning portion, such that a space for receiving the first dust-preventing portion is formed at the turning portion, and the turning portion is located beneath the second dust-preventing portion.

10. The sliding variable resistor as claimed in claim 4, wherein the substrate further includes a connector, and the upper casing further includes an opening portion corresponding to the connector.

* * * * *